US006128783A

United States Patent [19]

Blauer et al.

[11] Patent Number: 6,128,783

[45] Date of Patent: Oct. 10, 2000

[54] REVERSIBLE SWEATER WITH OPPOSING SIDES THAT OPTIONALLY PRESENT EITHER CUSTOMARY APPEARANCE OR ENHANCED VISIBILITY

[75] Inventors: Stephen J. Blauer, Lexington, Mass.; Mark A. Mordecai, Hampton, N.H.; Toufic G. Atallah, Reading, Mass.

[73] Assignee: Blauer Manufacturing Company, Inc., Boston, Mass.

[21] Appl. No.: 09/197,872

[22] Filed: Nov. 23, 1998

[51] Int. Cl.[7] ..... A41D 1/04

[52] U.S. Cl. ..... 2/90; 2/DIG. 2

[58] Field of Search ..... 2/90, 94, 93, DIG. 2; 8/648

[56] References Cited

U.S. PATENT DOCUMENTS

| | | | |
|---|---|---|---|
| 1,371,841 | 3/1921 | Berkwits . | |
| 2,263,544 | 11/1941 | Rosenstein . | |
| 2,711,539 | 6/1955 | Loscher . | |
| 2,890,460 | 6/1959 | Levi . | |
| 3,492,676 | 2/1970 | King . | |
| 3,710,394 | 1/1973 | Trice | 2/74 |
| 3,837,007 | 9/1974 | Girest | 359/519 |
| 4,472,835 | 9/1984 | Clark | 2/102 |
| 4,783,858 | 11/1988 | Chevalier | 2/90 |
| 4,815,146 | 3/1989 | Theewis et al. | 2/94 |
| 5,029,344 | 7/1991 | Shannon et al. | 2/69 |
| 5,561,860 | 10/1996 | Nguyen-Senderowicz | 2/90 |
| 5,787,503 | 8/1998 | Murphy, III | 2/90 |

FOREIGN PATENT DOCUMENTS

| | | |
|---|---|---|
| 408783 | 2/1933 | United Kingdom . |
| 419468 | 7/1933 | United Kingdom . |
| 541770 | 11/1940 | United Kingdom . |
| 2044599 | 3/1979 | United Kingdom . |

*Primary Examiner*—John J. Calvert
*Assistant Examiner*—Shirra L. Jenkins
*Attorney, Agent, or Firm*—Morse, Altman & Martin

[57] ABSTRACT

A reversible sweater has a pair of contiguous configurations, one composed of a knit fabric and the other composed of a micro-fiber fabric. A wearer may select which side of the reversible sweater to wear outside and/or inside. If the knit side is worn outside, the sweater (1) has a conventional appearance, but (2) provides warmth which is a function of the knit configuration, and wind resistance, water resistance and vapor permeability, all of which are functions of the micro-fiber configuration. If the micro-fiber configuration is worn outside, (1) the sweater has a fluorescent and retro-reflective appearance, but provides (2) warmth which is a function of the knit configuration, and (3) wind resistance, water resistance and vapor permeability, all of which are functions of the micro-fiber configuration.

16 Claims, 4 Drawing Sheets

REVERSIBLE SWEATER WITH OPPOSING SIDES THAT OPTIONALLY PRESENT EITHER CUSTOMARY APPEARANCE OR ENHANCED VISIBILITY

BACKGROUND OF THE INVENTION

1. Field of the Invention

The present invention relates to clothing and, more particularly, to reversible sweaters that optionally present either customary appearance or enhanced visibility.

Clothing fabrics may be chosen for any of a myriad of objectives, for example: aesthetics provided by patterns, colors, or textures; heat retention provided by natural and/or synthetic yarns of various densities, weaves, knits and/or processing; weather protection, particularly water and/or wind resistance or repellency, provided by coatings and/or laminates; and comfort provided by drape, contour, and/or breathability.

2. The Prior Art

Reversible clothing is constructed from fabrics or combinations of fabrics that may strive to achieve differing objectives. Such objectives may feature opposing textile layers or sides, which merely are intended to present different designs, but which are provided by textiles that are otherwise alike in physical, particularly mechanical, characteristics. In this case, tailoring of the two layers is relatively simple because of their physical compatibility. Such objectives alternatively may feature opposing layers or sides that are intended to provide either (1) customary appearance and function, or (2) enhanced optical and/or weather resistant features. In this case, tailoring of the two layers may be relatively difficult because of substantial differences in physical, particularly, mechanical characteristics.

SUMMARY OF THE INVENTION

The present invention relates to a reversible sweater having a pair of contiguous and interacting textile configurations that combine versatile weather protection with either customary appearance or enhanced visibility. Each configuration includes a full bodice and full sleeves for deployment on the inside or the outside of the sweater, at the option of the wearer. One configuration is a relatively thick, relatively soft knit stratum, which is characterized by conventional appearance, drape, and multidirectional stretch. The other configuration is a relatively thin, relatively stiff micro-fiber stratum, which is impregnated with a fluorescent dye and a weather resistant but moisture permeable composition, and to which is affixed a plurality of retro-reflective bands. The two configurations are free to shift with respect to each other because they are stitched together only at restricted strategic locations, primarily at the collar, cuffs and lower hem. The arrangement is such that, no matter what the reversible option selected, the inner portions of the cuffs, collar and bottom hem are inwardly contiguous with the wearer's body, and the outer portions of the cuffs, collar and bottom hem are outwardly visible to an observer.

BRIEF DESCRIPTION OF THE DRAWINGS

For a fuller understanding of the nature and objects of the present invention, reference is made to the following specification, which is to be taken in connection with the accompanying drawings, wherein.

DETAILED DESCRIPTION OF THE PREFERRED EMBODIMENTS

The Embodiment of FIGS. 1 to 5

Figure 1:
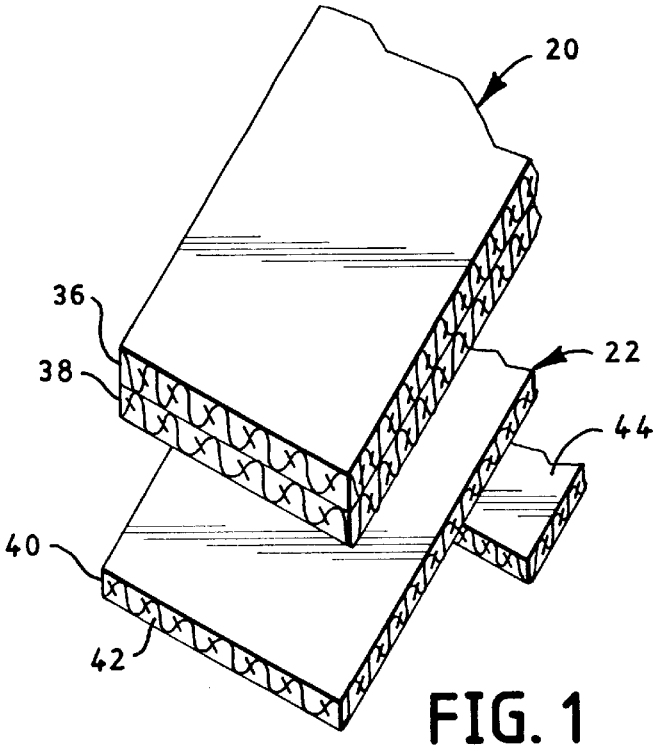
FIG. 1 is a grossly exaggerated view of one embodiment of the fabric construction of the present invention, cross-sectioned to suggest fabric densities and impregnation.
Figure 2:
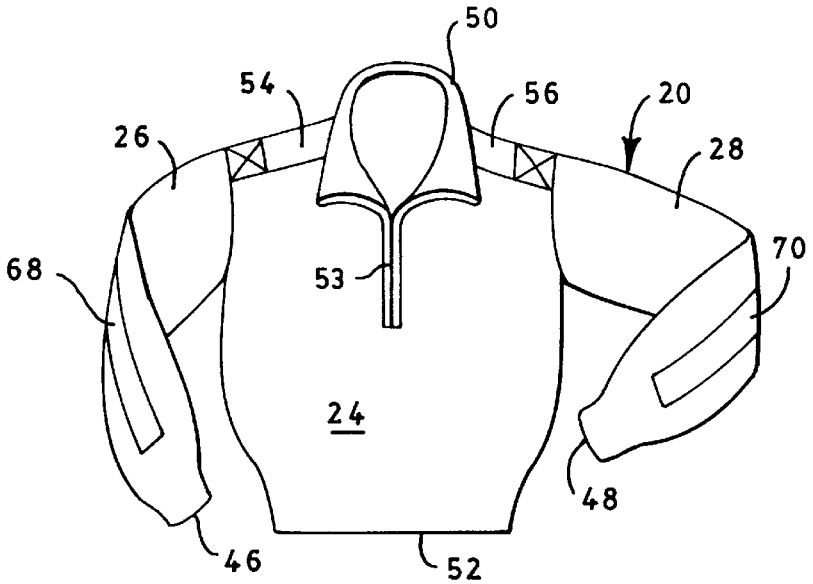
FIG. 2 is a front perspective view of a sweater, knit side out, embodying the fabric construction of FIG. 1.
Figure 3:
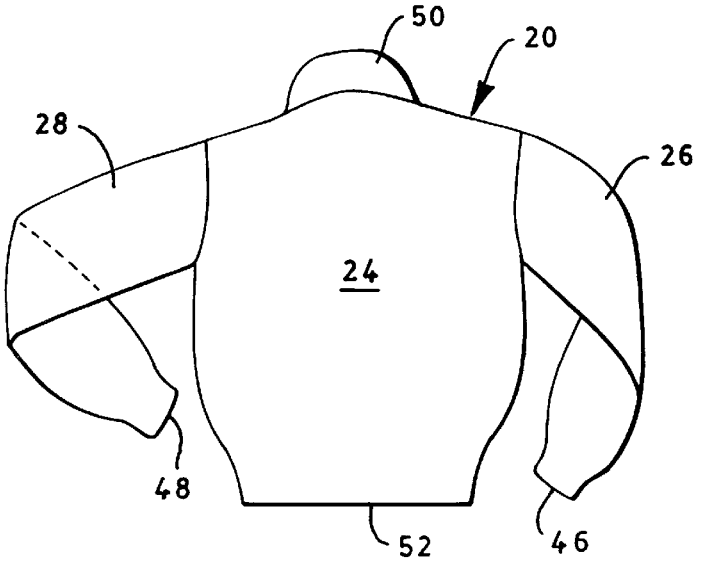
FIG. 3 is a back perspective view of the sweater as shown in FIG. 2.
Figure 4:
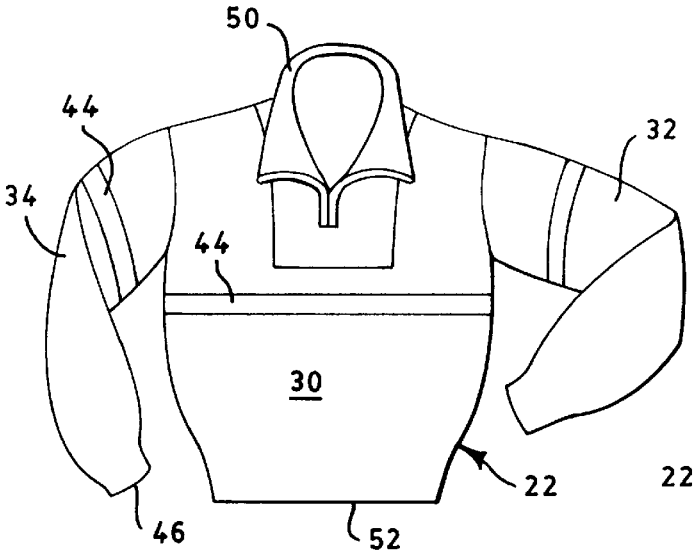
FIG. 4 is a front perspective view of the sweater of FIG. 2, fluorescent side out.
Figure 5:
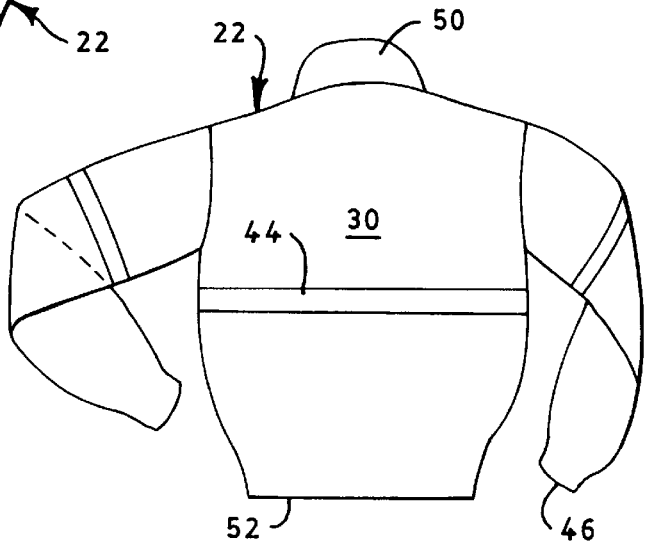
FIG. 5 is a back perspective view of the sweater as shown in FIG. 4.
Figure 6:
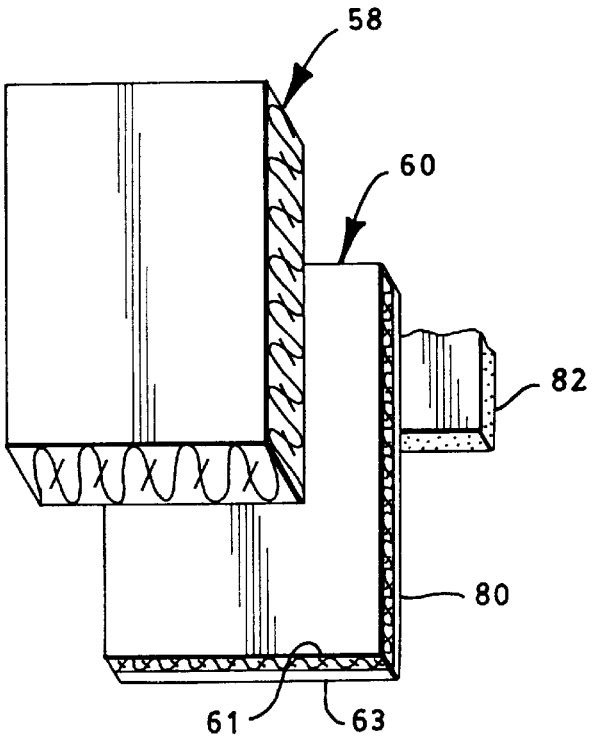
FIG. 6 is a grossly exaggerated view of another embodiment of the fabric construction of the present invention, cross-sectioned to suggest fabric densities and impregnation.
Figure 7:
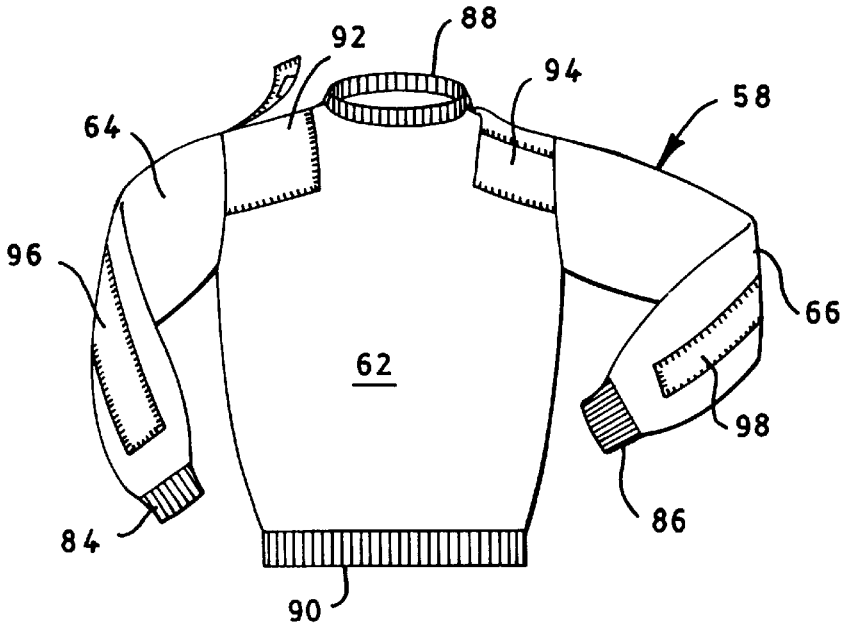
FIG. 7 is a front perspective view of a sweater, knit side out, embodying the fabric construction of FIG. 6.
Figure 8:
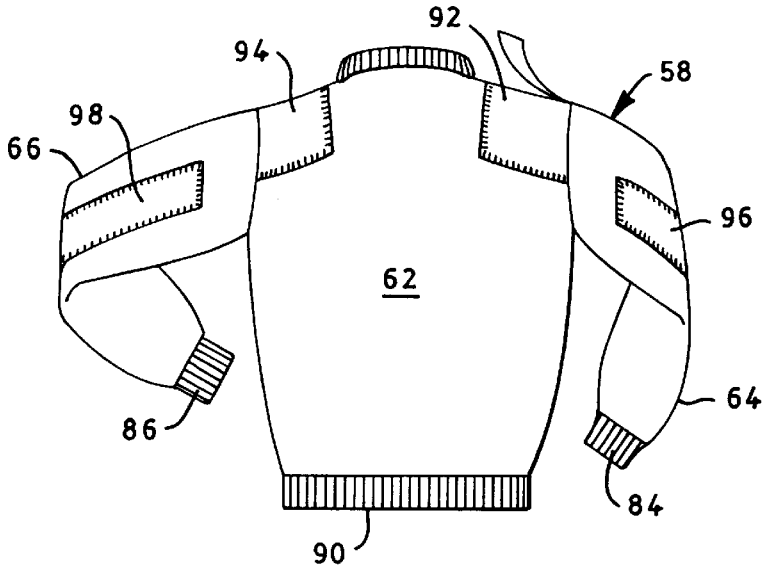
FIG. 8 is a back perspective view of the sweater as shown in FIG. 7.
Figure 9:
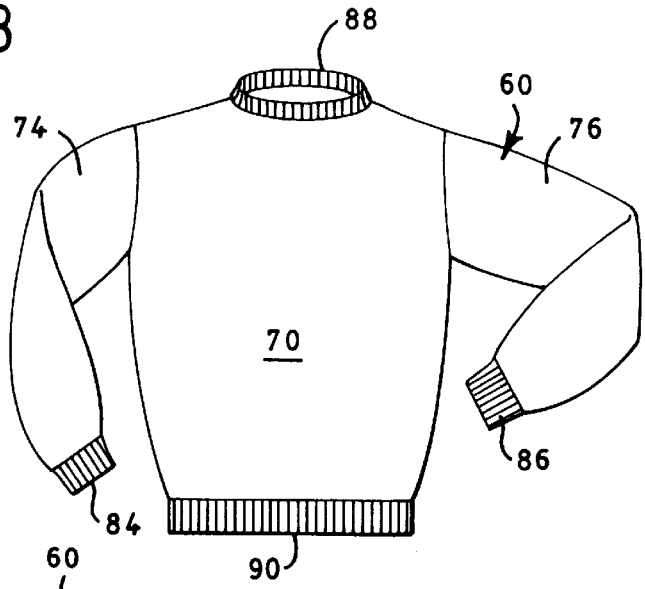
FIG. 9 is a front perspective view of the sweater of FIG. 7, fluorescent side out.
Figure 10:
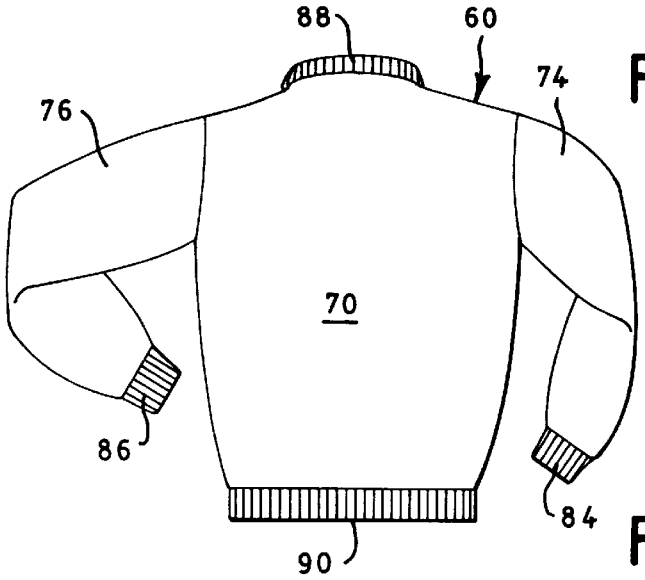
FIG. 10 is a back perspective view of the sweater as shown in FIG. 9.

The embodiment of FIGS. 1 to 5 is shown as comprising a pair of reversible configurations 20 and 22. As shown in FIGS. 2 and 3, configuration 20 includes a bodice 24 and a pair of sleeves 26, 28, which are stitched to bodice 24 at the shoulders. As shown in FIGS. 4 and 5, configuration 22 includes a bodice 30 and a pair of sleeves 32,34, which are stitched to bodice 30 at the shoulders. The contiguous shoulders of configurations 20 and 22 are free from each other, i.e. are not stitched together.

As shown, configuration 20 is a two layer fabric of conventional appearance having a jersey knit face 36 and a low pile velour back 38. As shown, configuration 22 is a micro-fiber fabric 40 that is impregnated with water repellant and fluorescent finishes 42, and carries a plurality of retro-reflective bands 44. Knit configuration 20 is relatively thick and relatively compliant. Micro-fiber configuration 22 is relatively thin and relatively stiff.

The cuffs of sleeves 26,28 are respectively joined by stitching at 46,48. The necks of bodices 24,30 are joined at a collar 50. The waists of bodices 24,30 are respectively joined at a bottom hem 52.

Woven and micro-fiber configurations 20, 22 are generally coextensive throughout the sweater. The micro-fiber configuration is designed to have added ease, i.e. is fuller than the knit configuration, across the front and back shoulders on the body and around the armhole on the sleeves with two added shoulder pleats (not shown) set in the top seam. The attachment is such as to allow for full freedom of movement when worn over a uniform shirt. Configuration 22 is single needle stitched to configuration 20 at the cuffs, back collar, and bottom hem. There is an access opening at the bottom of the back hem measuring approximately 8 inches long, with a tack stitch at the center which can be opened to allow access to the interstice between the configurations for customization, including the sewing on of emblems. Bands 44 of specified retro-reflective material are sewn around the front and back chest and around the upper arms in such a way as to line up horizontally. Thus, only the critical regions of the inner and outer configurations are joined to each other. The arrangement is such that generally the inner and outer configurations are relatively free to adjust to the body contours and positions of the wearer despite significant differences in their drape and stretch.

Example I

The following example is the specification for the sweater of FIGS. 1 to 5, a reversible pullover embodying the present invention. The color of knit configuration 20 is blue. The color of fluorescent configuration 40 is yellow.

KNIT FABRIC CONFIGURATION: a stretch bi-component jersey knit fabric with durable nylon/spandex face and a non-pill, low pile polyester velour back. Nylon is a hexamethylene adipamide polymer sold by DuPont. Spandex is an elastomer of the type sold by DuPont under the trade designation LYCRA. This bi-component is of the type sold by Malden Mills under the trade designation POLARTEC #7766, the weight of which is 8.5 oz/yd$^2$.

HIGH-VISIBILITY/WINDPROOF-BREATHABLE CONFIGURATION: RipStop nylon 100% polyester micro-fiber fabric with durable water repellent finish of the type sold by Burlington Klopman Fabrics under the trade designation VERSATECH #3706, the weight of which is 2.3 oz/yd$^2$. The construction is Warp-179 and Fill-117 finished. The windproofness is <2.0 CFM (Frasier test). The breathability is 7000 g/m$^2$/24 hrs (ASTM E 96-80 Procedure BW).

PATCH AND TRIM FABRIC: Knit configuration 20 is provided with patch and trim features. These features are composed of a machine washable and dry cleanable cotton blend conforming to the following specifications in order to provide user comfort, uniform appearance, durability, and easy care. Cloth type is 6.5 oz. per square yard 2×1 twill weave in a 65% polyester/35% cotton fiber blend with 10–12% filling stretch that is precured for wrinkle resistance and treated with a soil-release finish. The count of this fabric is Warp-87 and Fill-52. The following further numerical specifications are average values and may vary plus or minus 10%. Tensile Strength is Warp-190 lbs and Fill-80 lbs (ASTM D 1682). Tear Strength is Warp-10.0 lbs and Fill-5.0 lbs (ASTM D 1424). Shrinkage is Warp-2.3% and Fill-1.7% (Washed 3 cycles at 120 F/12SF Tumble Dry)

RETRO-REFLECTIVE BANDS: Sew-on glass micro-bead retro-reflective material sold by 3M under the trade designation SCOTCHLITE #8930.

ZIPPER: The front zipper 53 is a size #5 nylon coil with reversible slider, color black, length 9.5 inches.

BINDING: The bindings of the cuffs and bottom hem are 1.5 inch nylon/spandex knit of black color.

TAPE REINFORCEMENT: Shoulder reinforcement tape is 0.25 inch urethane elastomer.

THREAD: Type is 100% polyester, size #50.

SEAM STITCHING: Joining seams on the knit and microfiber configurations are of five thread safety stitch construction. All other seams are of single needle lock stitch construction. Back tacks on seams are a minimum of 0.5 inches long. All seams are 8 stitches per inch minimum to 12 stitches per inch maximum.

TAPE REINFORCEMENT: The top shoulder seams are reinforced with the specified tape to prevent their separation under stress. The tape runs the entire length of the shoulder seam.

ELBOW PATCHES: The knit configuration has reinforcing patches 68,70 on the sleeves. Each sleeve patch is contoured to fit the arm, measuring approximately 11 inches long, 5 inches wide across the bottom and 7 inches across the top. The patches and the thread used to stitch them match the color of the knit configuration. The patches, with raw edges turned in, are secured by a double needle lock stitch except for the edge incorporated into the sleeve seam, which is overlocked.

EPAULETS: A pair of epaulets 54,56 are made from two plies of reinforcement fabric and one ply of fusible interlining for added shape retention. The plies are stitched, turned inside out and top stitched. Each epaulet is set to the shoulder, turned back on itself, and then top stitched parallel to the sleeve setting seam. The epaulets are attached to the shoulder by stitching the sides of the ■V■ at the point along both sides.

The Embodiment of FIGS. 6 to 10

The embodiment of FIGS. 6 to 10 is a commando type sweater that is shown as comprising a pair of configurations 58,60. Configuration 58 includes a bodice 62 and a pair of sleeves 64,66, which are stitched to bodice 62 at the shoulders. Configuration 60 includes a bodice 70 and a pair of sleeves 74,76, which are stitched to bodice 70 at the shoulders.

As shown, configuration 58 is composed of a fabric of conventional appearance characterized by a knit of long staple synthetic and natural composite yarn. As shown, configuration 60 includes, as laminated layers, a micro-fiber fabric 61 that is impregnated with a water repellent and fluorescent finish 80, and a knit polyester fabric 63. Configuration 60 carries a plurality of retro-reflective bands 82. Configuration 58 is relatively thick and relatively compliant. Configuration 60 is relatively thin and relatively stiff. The reversible sweater is of a pullover style, jersey knit with straight body, knitted welt, and set-in sleeves 64,66. Durable cloth patches 92,94,96,98 as specified reinforce shoulders and elbows. The cuffs 84,86 of the sleeves are provided by rib knit band doubled over. A waist 90 for the bodices is provided by a rib knit band doubled over. The necks of the bodices are provided with a collar 88 in the form of a rib knit band doubled over and joined at the bottom, overlock stitched to the body and reinforced stitched at the bottom of the collar. Except for the cuffs, collar and waist, knit configuration 58 and micro-fiber configuration 60 are generally contiguous so that they may be turned inside out.

With the exception of the collar and neck region, the woven and micro-fiber configurations are completely coextensive throughout the sweater. The micro-fiber configuration is designed to have added ease, i.e. is fuller than the knit configuration, across the front and back shoulders on the body. The attachment is such as to allow for full freedom of movement when worn over a uniform shirt. The bands of specified retro-reflective material are sewn around the front and back chest and around the upper arms in such a way as to line up horizontally. The arrangement is such that, generally and except for the critical regions where the inner and outer configurations are joined to each other, the configurations, including their bodices and sleeves, are relatively free to adjust to the body contours and positions of the wearer.

Example II

The following example is the specification for a reversible high-visibility commando-type sweater embodying the present invention. The color of the knit configuration is blue. The color of the fluorescent configuration is yellow.

THE KNIT CONFIGURATION: Type is 70% Monsanto 5-63 long-staple, low-pill acrylic, 30% long-staple spun wool, pre-washed and softened. Count is Worsted 2 ply/18's.

HIGH-VISIBILITY WINDPROOF-BREATHABLE CONFIGURATION: The windproof-breathable lining consists of a WindStopper windproof-breathable membrane laminated to a knit polyester fabric resulting in a dry cleanable and washable windproof material with high moisture vapor transmission. The windproof-breathable membrane has: a moisture vapor transmission rate of $g/m^2/24$ hrs minimum-Procedure B 900 ASTM E 96-80; and 7000 $g/m^2/24$ hrs minimum-Procedure BW ASTM E 96-80. Windproofness is <1.0 CFM (Frasier). Fabric is 2.0 $oz/yd^2$ polyester knit, color-fluorescent yellow.

PATCH FABRIC: a machine washable and dry cleanable cotton blend conforming to the following specifications in order to provide user comfort, uniform appearance, durability, and easy care. Cloth type is 6.5 oz. per square yard 2×1 twill weave in a 65% polyester/35% cotton fiber blend with 10–12% filling stretch that is precured for wrinkle resistance and treated with a soil-release finish. Count is Warp-87 and Fill-52. Tensile Strength is Warp-190 lbs and Fill-80 lbs (ASTM D 1682). Tear strength is Warp-10.0 lbs and Fill-5.0 lbs (ASTM D 1424).Shrinkage is Warp-2.3% and Filling-1.7%.

REFLECTIVE TRIM: Reflective trim is glass micro-bead silver 1.5 inch sew-on retro-reflective material sold by 3M under the trade designation Scotchlite #8930.

TAPE REINFORCEMENT: 100% polyester woven tape, 0.25 inches wide. Color-black

THREAD: 100% polyester size #50.

KNITTING: a plain jersey stitch throughout using 0.54 inches of yarn per stitch with an integral 1×1 rib knit bottom and cuff using 0.46 inches of yarn per stitch commencing with a knitted welt.

THE NECK: The knit band is 1×1 rib knit to match the bottom rib and cuff.

SEAM CONSTRUCTION: All sweater seams are stitched using an overlock machine with two ends of yarn and one end of the specified thread for strength and a neat appearance. All threads and yarns match the color of the sweater.

TAPE REINFORCEMENT: The shoulders and underarms are reinforced with the specified tape to prevent these seams from coming apart under stress. The tape measures approximately 4 inches in length under the arm and runs the entire length of the shoulder seam.

SHOULDER AND ELBOW PATCHES: The sweater has reinforcing patches on each shoulder and sleeve. When the sweater is laid flat, the bottom of each shoulder patch meet when a straight line is drawn from patch to patch, insuring a uniform appearance. The patches and the thread used to stitch them on match the color of the sweater. The patches, with raw edges turned in, are secured by a double needle lock stitch except for the edge incorporated into the sleeve seam which is overlocked. The shoulder patch measures approximately 9.75 inches by 5.5 inches finished (size medium) and is graded for smaller and larger sizes. The sleeve patch is contoured to fit the arm, measuring approximately 11 inches by 5 inches finished (all sizes).

EPAULETS: The epaulets have three points and are made from two plies of reinforcement fabric and one ply of fusible interlining for added shape retention. The plies are stitched, turned inside out and top stitched. Each epaulet is set to the shoulder, turned back on itself, and then top stitched parallel to the sleeve setting seam. It finishes 2 inches wide at the shoulder seam, tapering to 1.75 inches wide at the pointed end. The epaulets are attached to the shoulder patch using a 1 by 1 inch piece of hook and loop pile fastener sewn as close to the pointed end as possible.

WEIGHT: The minimum weight of a dozen size medium sweaters is 18 pounds.

OPERATION

In operation, a wearer may select which side of the reversible sweater to wear outside and/or inside. If the knit side is worn outside, the sweater (1) has a conventional appearance, but (2) provides warmth which is a function of the knit configuration, and (3) provides wind resistance, water resistance and vapor permeability, all of which are functions of the micro-fiber configuration. If the micro-fiber configuration is worn outside, (1) the sweater has a fluorescent and retro-reflective appearance, but provides (2) warmth which is a function of the knit configuration, and (3) wind resistance, water resistance and vapor permeability, all of which are functions of the micro-fiber configuration. The knit configuration is relatively thick, relatively soft, and provides multidirectional stretch. The micro-fiber configuration is composed of a relatively rigid material but is relatively thin so as to be reasonably compliant. The two configurations are stitched together primarily at their necks, cuffs and lower hem. The two configurations are slightly different in size so that they are generally free to shift with respect to each other to accommodate different body contours and positions.

What is claimed is:

1. A reversible sweater comprising a first textile configuration and a second textile configuration, said configurations being opposed contiguously, each configuration including a bodice and sleeves for deployment on the inside or the outside of the sweater, at the option of the wearer;

(a) said first configuration including a relatively thick, relatively soft knit stratum, which is characterized by conventional appearance and multidirectional stretch;

(b) said second configuration including a relatively thin micro-fiber stratum, which contains a fluorescent dye and a moisture permeable composition;

(c) said first configuration and said second configuration being stitched together primarily at their necks, cuffs and lower hem; and (d) said first configuration and said second configuration being generally free to shift with respect to each other.

2. The reversible sweater of claim 1 wherein one of said configurations is slightly larger in size than the other of said configurations.

3. The reversible sweater of claim 1 wherein said micro-fiber configuration is slightly larger in size than said knit configuration.

4. The reversible sweater of claim 1 wherein said knit configuration incorporates a nylon containing knit face and a polyester velour back.

5. The reversible sweater of claim 1 wherein said micro-fiber configuration is a polyester.

6. A reversible sweater comprising a first textile configuration and a second textile configuration, said configurations being opposed contiguously, each configuration including a bodice and sleeves for deployment on the inside or the outside of the sweater, at the option of the wearer;

(a) said first configuration being a relatively thick, relatively soft knit stratum, which is characterized by conventional appearance and multidirectional stretch;

(b) said second configuration being a relatively thin micro-fiber stratum, which contains a fluorescent dye and a moisture permeable composition;

(c) a plurality of retro-reflective bands affixed to a contiguous surface of said micro-fiber stratum;

(d) said first configuration and said second configuration being stitched together primarily at their necks, cuffs and lower hem;

(e) said first configuration and said second configuration being generally free to shift with respect to each other; and (f) the inner portions of said cuffs, neck and bottom hem being contiguous inwardly with the wearer's body, and the outer portions of the cuffs, neck and bottom hem being presented outwardly.

7. The reversible sweater of claim 6 wherein one of said configurations is slightly larger in size than the other of said configurations.

8. The reversible sweater of claim 6 wherein said micro-fiber configuration is slightly larger in size than said knit configuration.

9. The reversible sweater of claim 6 wherein said knit configuration incorporates a nylon containing knit face and a polyester velour back.

10. The reversible sweater of claim 6 wherein said micro-fiber configuration is a polyester.

11. A reversible sweater comprising a first textile configuration and a second textile configuration, said configurations being opposed contiguously, each configuration including a bodice and sleeves for deployment on the inside or the outside of the sweater, at the option of the wearer;

(a) said first configuration being a relatively thick, relatively soft knit stratum, which is characterized by conventional appearance and multidirectional stretch;

(b) said second configuration being a relatively thin micro-fiber stratum, which contains a fluorescent dye and a moisture permeable composition;

(c) a plurality of retro-reflective bands affixed to a contiguous surface of said micro-fiber stratum;

(d) said first configuration and said second configuration being stitched together primarily at their necks, cuffs and lower hem;

(e) said first configuration and said second configuration being generally free to shift with respect to each other; and (f) the inner portions of said cuffs, neck and bottom hem being contiguous inwardly with the wearer's body, and the outer portions of the cuffs, neck and bottom hem being presented outwardly.

12. The reversible sweater of claim 11 wherein one of said configurations is slightly larger in size than the other of said configurations.

13. The reversible sweater of claim 11 wherein said micro-fiber configuration is slightly larger in size than said knit configuration.

14. The reversible sweater of claim 11 wherein said knit configuration incorporates a nylon containing knit face and a polyester velour back.

15. The reversible sweater of claim 11 wherein said micro-fiber configuration is a polyester.

16. A reversible sweater comprising a first textile configuration and a second textile configuration, said configurations being opposed contiguously, each configuration including a bodice and sleeves for deployment on the inside or the outside of the sweater, at the option of the wearer;

(a) said first configuration being a relatively thick, relatively soft knit stratum, which is characterized by conventional appearance and multidirectional stretch; said second configuration being a relatively thin micro-fiber stratum, which contains a fluorescent dye and a moisture permeable composition;

(b) a plurality of retro-reflective bands affixed to a contiguous surface of said micro-fiber stratum;

(c) said first configuration and said second configuration being stitched together primarily at their necks, cuffs and lower hem;

(d) said first configuration and said second configuration being generally free to shift with respect to each other;

(e) the inner portions of said cuffs, neck and bottom hem being contiguous inwardly with the wearer's body, and the outer portions of the cuffs, neck and bottom hem being presented outwardly;

(f) one of said configurations being slightly larger in size than the other of said configurations;

(g) said knit configuration incorporating a nylon containing knit face and a polyester velour back; and (h) said micro-fiber configuration being a polyester.

* * * * *